US006590173B2

(12) United States Patent
Uchida et al.

(10) Patent No.: US 6,590,173 B2
(45) Date of Patent: Jul. 8, 2003

(54) MOLDED CASE CIRCUIT BREAKER

(75) Inventors: Naoshi Uchida, Saitama (JP); Fumiyoshi Kawahara, Saitama (JP); Syuichi Sugiyama, Kanagawa (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/151,292

(22) Filed: May 21, 2002

(65) Prior Publication Data

US 2002/0175147 A1 Nov. 28, 2002

(30) Foreign Application Priority Data

May 28, 2001 (JP) ..... 2001-158049

(51) Int. Cl.[7] ..... H01H 1/22

(52) U.S. Cl. ..... 200/244; 335/16; 335/195

(58) Field of Search ..... 200/244, 248, 200/287, 144 R, 251, 250, 247; 335/195, 16, 185, 196, 200, 201; 218/22

(56) References Cited

U.S. PATENT DOCUMENTS 4,910,485 A * 3/1990 Bolongeat-Mobleu et al. ... 200/244

FOREIGN PATENT DOCUMENTS

| | | |
|---|---|---|
| JP | 6-52777 | 2/1994 |
| JP | 1-166429 | 6/2001 |

* cited by examiner

*Primary Examiner*—Elvin Enad
*Assistant Examiner*—M. Fishman
(74) *Attorney, Agent, or Firm*—Kanesaka & Takeuchi

(57) ABSTRACT

A current-interrupting section of a molded case circuit breaker includes fixed contact shoes and a rotary bridge-type contact shoe held in a contact shoe holder. A pair of pressure springs is assembled in the contact shoe holder to press the rotary contact shoe to the fixed contact shoes. The pressure spring is torsion coil springs and have U-shaped offset arm portion drawn out from the center of the coil. A pair of the torsion coil springs is arranged above and under the rotary contact shoe. Furthermore, legs of the torsion coil springs at ends are hooked to sidewalls of the contact shoe holder. The offset arm portions at the center of the torsion coil springs engage the rotary contact shoe at positions symmetrical with respect to the rotational center of the rotary contact shoe.

6 Claims, 4 Drawing Sheets

MOLDED CASE CIRCUIT BREAKER

BACKGROUND OF THE INVENTION AND RELATED ART STATEMENT

The present invention relates to a molded case circuit breaker, and more specifically, to an assembled structure of a current-interrupting section having fixed contact shoes and a rotary bridge-type contact shoe.

First, a general configuration of a molded case circuit breaker is schematically shown in FIG. 5. In this figure, reference numeral 1 denotes a main body case of a circuit breaker, 2 is an opening and closing handle or a switching handle, 3 is a toggle type opening and closing mechanism or a switching mechanism, and 4 is an over-current tripping device (based on a bimetal method or the like). Reference numeral 5 is a current-interrupting section containing fixed contact shoes, a movable contact shoe and arc extinguishing devices of a main circuit, and is linked to the opening and closing mechanism 3. An opening and closing operation of such a circuit breaker is well known. Through an ON/OFF operation of the opening and closing handle 2, the movable contact shoe in the current-interrupting section 5 opens or closes via the opening and closing mechanism 3. Further, when an over-current flows to activate the over-current tripping device 4 while the main circuit is powered, the opening and closing mechanism 3 performs a trip operation to open the movable contact shoe in the current-interrupting section 5, thereby interrupting the over-current flowing through the main circuit.

An interrupting method used for the current-interrupting section 5 includes a single-break method and a double-break method. An example of a double-break method using a movable contact shoe equipped with a bridging rotary contact shoe is disclosed in Japanese Patent Publications (KOKAI) No. 06-028964 and No. 06-52777. A configuration of this circuit breaker is shown in FIGS. 6(*a*) and 6(*b*). In this figure, reference numeral 6 denotes an insulated case of the current-interrupting section 5; 7 shows power-supply-side and load-side fixed contact shoes disposed in the insulated case 6 and arranged diagonally opposite to each other; 7*a* is a fixed contact provided at a tip portion of each fixed contact shoe; 8 is a movable contact shoe that bridges the contacts of the fixed contact shoes 7; 9 is a rotary drum-shaped contact shoe holder that holds the movable contact shoe 8; and 10 is an arc extinguishing device or a grid positioned at each side of the movable contact shoe 8 and disposed in the insulated case 6. The movable contact shoe 8 is loosely fitted in a through-hole 9*a* formed in the contact shoe holder 9, and is urged and held in position in the contact shoe holder 9 by a pressure spring (a tension spring or a torsion coil spring) 11.

In the illustrated structure, four tension springs are provided as the pressure spring 11, and two of them are arranged at each of the right and left sides of the movable contact shoe 8. Each tension spring is disposed vertically relative to the movable contact shoe 8, and extends between a rod 12 supported between right and left side walls of the contact shoe holder 9 and a rod 13 disposed on a top or bottom surface of the movable contact shoe 8. In this state, the movable contact shoe 8 is positioned and held in a floating sate and is pressed so that a force acts counterclockwise relative to the center of rotation 'O' thereof. Thus, at an activation position shown in the figure, a predetermined contact pressure is exerted between the movable contact shoe 8 and the contact 7*a* of each of the fixed contact shoes 7.

Further, the tip portion of each of the fixed contact shoes 7 is folded in a U-shape. When an over-current such as short circuit current flows through the main circuit, the movable contact shoe 8 is substantially instantaneously opened before the over-current tripping device 4 (see FIG. 5) operates by an electromagnetic resilient force exerted between the tip portions of the fixed contact shoes 7 and the movable contact shoe 8. Furthermore, the folded portion of each fixed contact shoe has a magnetic yoke 14 to enhance a magnetic field acting on an arc generated between the contacts of the fixed and movable contact shoes during current interruption, thereby increasing the electromagnetic arc driving force to the arc extinguishing devices 10.

A configuration in which the pressure spring 11 is formed of torsion coil springs instead of tension springs has been disclosed and known in Japanese Patent Publication (KOKAI) No. 01-166429. This assembled structure is shown in FIGS. 7(*a*) and 7(*b*). In this configuration, the pressure spring 11 is formed of two torsion coil springs, each being disposed at the right or left side of the movable contact shoe 8. One of the springs has its opposing ends interposed between a recess groove 8*a* formed on a top surface side of the movable contact shoe 8 and the contact shoe holder 9, while the other spring has its opposing ends interposed between a recess groove formed on a bottom surface side of the movable contact shoe 8 and the contact shoe holder 9. The springs thus urge the movable contact shoe 8 counter-clockwise with a predetermined contact pressure between the movable contact shoe 8 and the contact 7*a* of each of the fixed contact shoes 7 like the case shown in FIG. 6.

The current-interrupting section described above has the following problems. Namely, in the structure in FIG. 6(*b*) in which the pressure spring 11 of the movable contact shoe 8 is formed of the tension springs, the rods 13 and the rods 12 are provided at the top and bottom surfaces of the movable contact shoe piece 8 between the right and left side walls of the contact shoe holder 9, respectively. And, each tension spring is extended between the corresponding rods 13 and 12. The resulting structure becomes complex, and the procedure for mounting the pressure springs 11 is cumbersome. Furthermore, due to the nature of the tension springs, when the movable contact shoe 8 is opened by the electromagnetic force resulting from over-current, the spring force in a return direction, which pushes back the movable contact shoe piece 8 to a closed position, increases. Accordingly, in order to prevent inadvertent return contact between the contacts due to this spring force, a special mechanism for latching the movable contact shoe 8 to its open position is required, further complicating the structure and assembly.

In the structure in FIGS. 7(*a*) and 7(*b*), the pressure spring 11 is formed of the two pairs of the torsion coil springs arranged at the right and left sides of the movable contact shoe 8, and each spring is interposed in the space between the movable contact shoe 8 and the right or left side wall of the contact shoe holder 9. However, the space available between the movable contact shoe piece 8 and the right or left side wall of the contact shoe holder 9 is limited so small that if the torsion coil spring interposed in the corresponding space has a small coil length, it needs to have a large spring constant in order to exert a predetermined contact pressure on the movable contact shoe 8. Thus, even if the pressure spring 11 comprises the torsion coil springs as shown in FIGS. 7(*a*) and 7(*b*), when the movable contact shoe 8 is opened by the electromagnetic reaction force resulting from the over-current as described above, the spring forces of the torsion coil springs cause the delay of the opening. Moreover, when extension of an arc generated between the contacts suppresses the current and reduces the electromagnetic reaction force exerted on the movable contact shoe, the spring force pushes back the movable contact shoe 8 to its closed position where the contacts touch again.

The present invention has been made in view of these points, and an object of the invention is to provide a structure of a current-interrupting section of a molded case circuit breaker, in which pressure springs of a movable contact shoe can easily be assembled in a contact shoe holder of a current-interrupting section.

Another object of the invention is to provide a structure as stated above, wherein a difference in corresponding spring forces between a contact activation position of the movable contact shoe and an open position by the electromagnetic reaction force resulting from over-current is minimized, so that it is possible to effectively prevent the spring from pushing back the movable contact shoe to the contact position, thereby improving the reliability of the opening operation.

Further objects and advantages will be apparent from the following description of the invention.

SUMMARY OF THE INVENTION

To attain the objects, the present invention provides a molded case circuit breaker having a current-interrupting section in a main body case of the circuit breaker. The current-interrupting section is composed of an assembly of an insulated case; an arc-extinguishing device; a power-supply side and load side fixed contact shoes diagonally arranged with respect to each other; a bridge-type rotary or movable contact shoe extending between contacts of the fixed contact shoes; and a rotary drum contact shoe holder for holding the movable contact shoe linked to a switching mechanism of the circuit breaker. The fixed contact shoes are formed in a U-shape so that an electromagnetic reaction force exerted by an over-current drives the movable contact shoe in an opening direction.

The movable contact shoe is loosely fitted in a hole formed on the contact shoe holder in a diameter direction, and pressed to be held in a position via a pair of pressure springs assembled inside the contact shoe holder. The pressure springs are torsion coil springs, and each spring has a U-shaped offset arm portion drawn out from a central portion of a coil. The torsion coil springs are arranged in upper and lower portions of the movable contact shoe. Legs of the torsion coil springs at ends are engaged with and locked to sidewalls of the contact shoe holder. Further, the offset arm portions engage the movable contact shoe at symmetrical positions with respect to a rotational center thereof.

Specifically, the circuit breaker can be constructed in the following configurations. The legs of each of the torsion coil springs, which are located at the respective ends thereof, are bent in an L-shape, and are engaged and locked by fitting the legs in holes formed in corresponding sidewalls of the contact shoe holder. Alternatively, the legs of each of the torsion coil springs, which are located at the respective ends thereof, are bent in an L-shaped, and are engaged and locked in engaging grooves cut out in peripheral edges of the corresponding sidewalls of the contact shoe holder.

Recess grooves are formed on top and bottom surfaces of the movable contact shoe at positions symmetrical with respect to the center of the movable contact shoe, and the offset arm portions of the torsion coil springs engage the corresponding recess grooves. Alternatively, stepped portions are formed on the top and bottom surfaces of the movable contact shoe piece at positions symmetrical with respect to the center of the movable contact shoe, and the offset arm portions of the torsion coil springs engage the corresponding stepped portions.

As described above, the pressure springs of the movable contact shoe are formed of a pair of the torsion coil springs, each having the offset arm portion drawn out from the center of the coil. The torsion coil springs are arranged in upper and lower portions of the movable contact shoe and interposed between the left and right sidewalls of the contact shoe holder. Thus, in comparison with the assembled structure in which the torsion coil springs are disposed at the right and left sides of the movable contact shoe, as in the conventional example, a larger coil length with a larger number of turns can be used to thereby minimize a spring constant. Then, when the movable contact shoe is driven in an opening direction by the electromagnetic reaction force resulting from the over-current, a quick opening operation is achieved. It is unlikely that the movable contact shoe will be pushed back to its closed position by the spring force to cause the contacts to touch each other once again. Consequently, this will result in more reliable circuit-breaking operations.

Furthermore, as compared to the conventional structure in which the pressure springs are the tension springs, the present invention does not require any assembly parts such as the rods on which the tension springs are hooked, thus simplifying the structure. Moreover, the movable contact shoe can be pressed and held in a position for assembly simply by pushing the springs into the contact shoe holder into which the movable contact shoe is fitted and inserted.

DETAILED DESCRIPTION OF PREFERRED EMBODIMENT

Figure 1A:
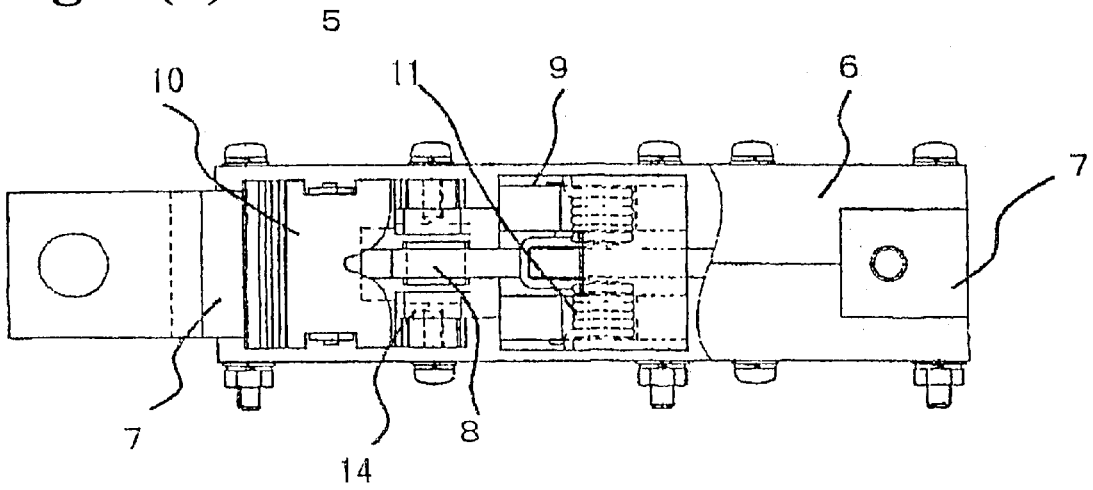
FIGS. 1(*a*) and 1(*b*) are a plan view and a side view, respectively, showing an internal structure of a current-interrupting section, and FIG. 1(*c*) is a perspective view showing an appearance of a movable contact shoe and a contact shoe holder in FIG. 1(*b*)

Hereunder, an embodiment of the present invention will be described with reference to the accompanied drawings. In the figures, the same parts as those in FIGS. 6(*a*) and 6(*b*) are denoted by the same reference numerals, and the description is omitted.

Figure 1B:
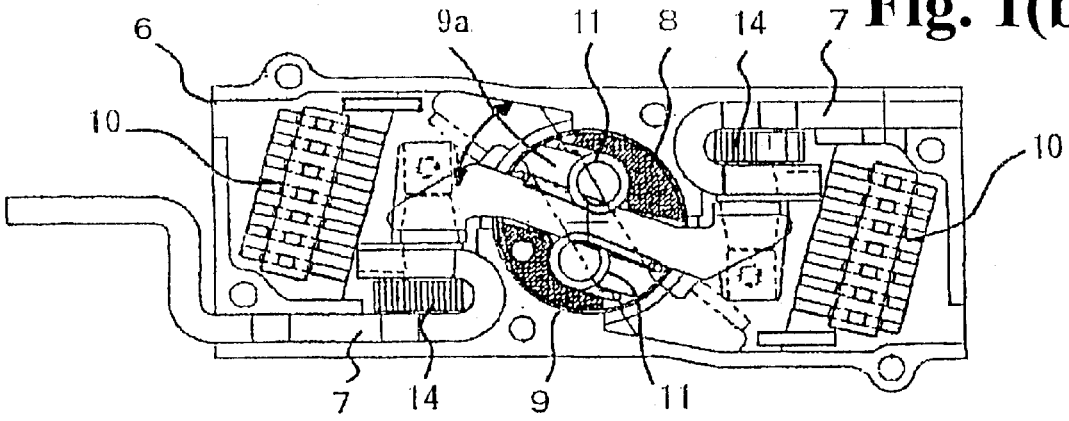
Figure 1C:
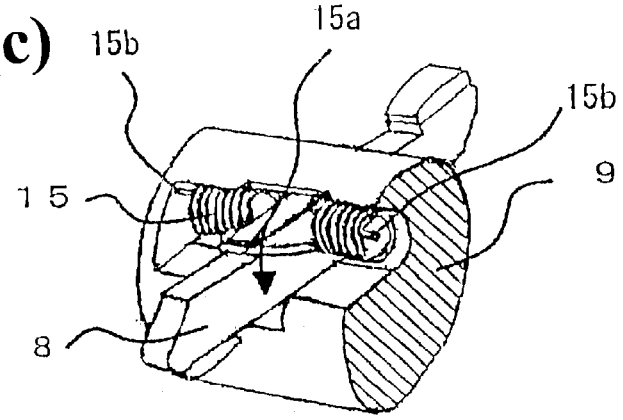
Figure 6A:
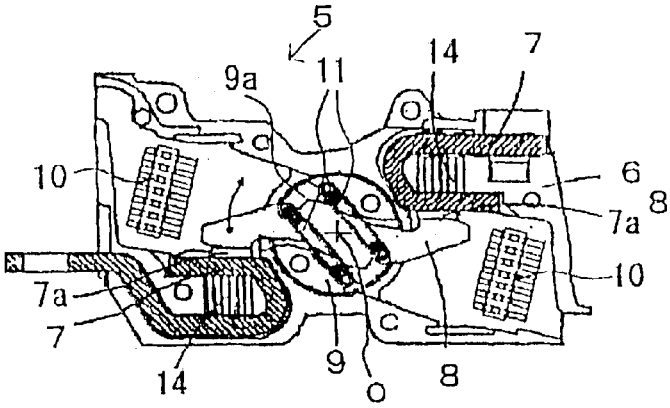
Fig. 6(a) Prior Art
FIG. 6(*a*) is a side view showing an internal structure of a current-interrupting section of a conventional example, and FIG. 6(*b*) is a perspective view showing an assembly of a movable contact shoe and a contact shoe holder in FIG. 6(*a*)
Figure 6B:
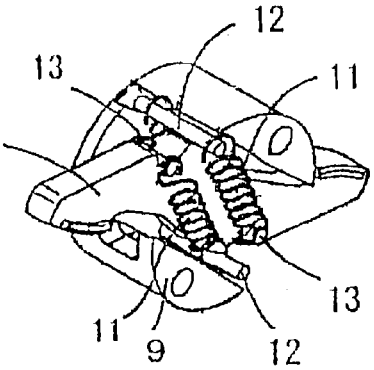
Fig. 6(b) Prior Art

First, in FIGS. 1(*a*) to 1(*c*), a current-interrupting section 5 of a molded case circuit breaker essentially has a configuration similar to that shown in FIGS. 6(*a*) and 6(*b*), but a support structure for a movable (rotary) contact shoe 8 held in a contact shoe holder 9 is different. As shown in FIG. 1(*c*), as the pressure springs 11, torsion coil springs 15 with offset arms 15*a* are disposed above and under the movable contact shoe 8 so as to press and hold the movable contact shoe 8 in a predetermined position.

Figure 3:
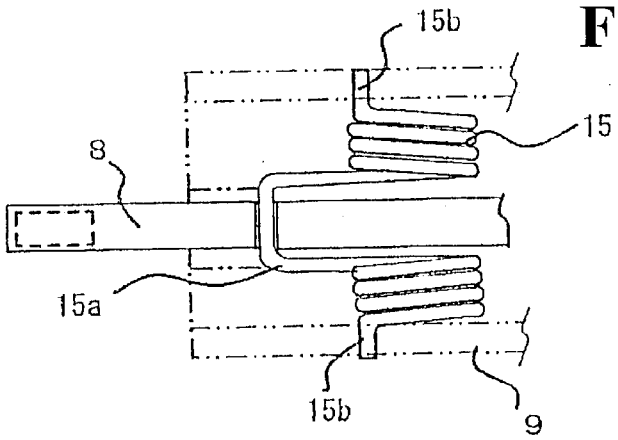
FIG. 3 is a plan view showing a structure of an essential part in FIG. 1(*c*) and FIG. 2.

The torsion coil spring 15 has the offset arm portion 15*a* formed in the center of the coil. The offset arm portion 15*a* has a U-shape and drawn out from the coil laterally, as shown in FIG. 3. Legs 15*b* are provided at respective ends of the coil and bent in an L-shape. The legs 15*b* are each engaged with and locked to right and left sidewalls of the contact shoe holder 9. A tip of the offset arm portion 15*a* is engaged with the movable contact shoe 8 so as to extend across the movable contact shoe 8. The torsion coil spring 15 disposed above the movable contact shoe 8 has the offset arm portion 15*a* engaged with a top surface of the movable contact shoe 8. Furthermore, the torsion coil spring 15 disposed under the movable contact shoe 8 has the offset arm portion 15*a* engaged with the bottom surface of the movable contact shoe 8. Furthermore, the engaging points of the upper and lower springs are set at positions symmetrical with respect to a rotational center 'O' of the movable contact shoe 8 in order to apply forces thereto.

Thus, the movable contact shoe 8 is held so as to float in the contact shoe holder 9, and urged counterclockwise around the rotational center 'O' by the springs. At a contact activation position in FIG. 1(*b*), a predetermined contact pressure is exerted between the movable contact shoe 8 and each of the fixed contact shoes 7.

Figure 2:
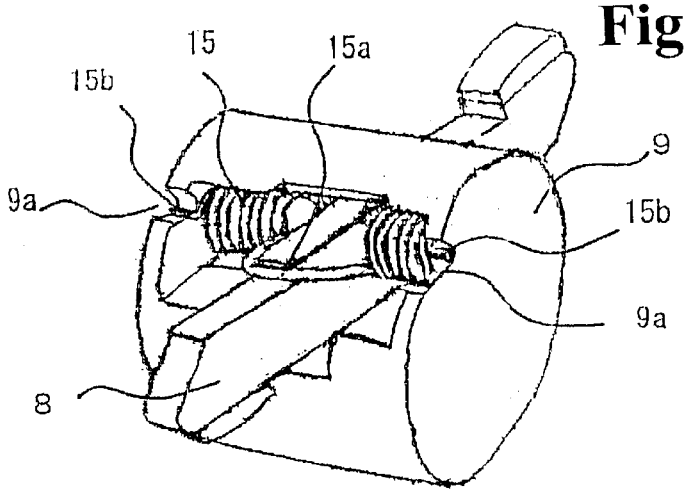
FIG. 2 is a perspective view showing an external configuration of a movable contact shoe and a contact shoe holder.
Figure 4A:
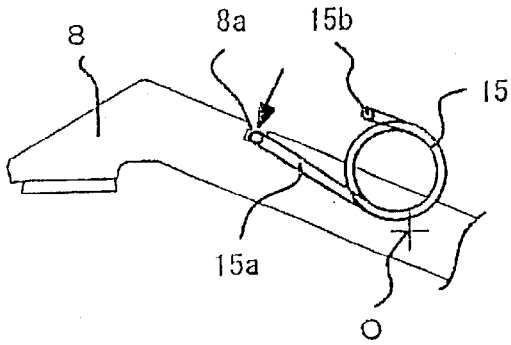
FIGS. 4(*a*) and 4(*b*) are side views of a movable contact shoe.
Figure 4B:
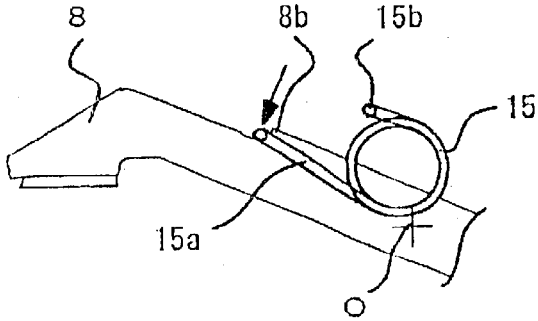
Figure 5:
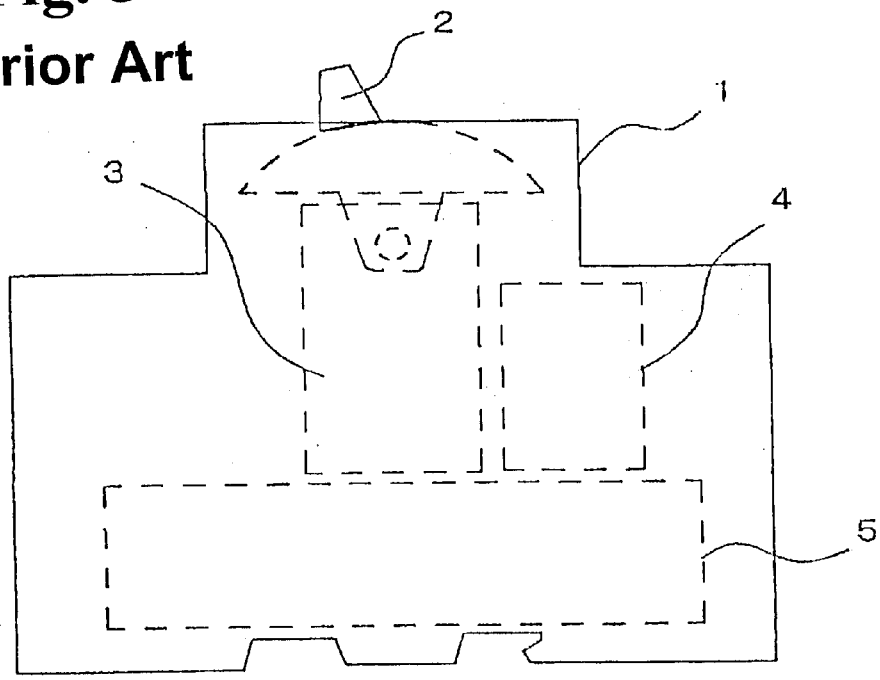
Fig. 5 Prior Art
FIG. 5 is a schematic view showing a configuration of a conventional molded case circuit breaker.

As shown in FIG. 1(*c*), the legs 15*b* may be inserted into a hole on the right and left sidewalls of the contact shoe holder for engagement. Alternatively, the legs 15*b* may be engaged and locked in cutout grooves 9*a* formed on peripheral edges of the right and left sidewalls of the contact shoe holder 9, as shown in FIG. 2. Furthermore, a recess groove 8*a* may be formed on the movable contact shoe 8 so that the tip of the offset arm portion 15*a* can engage the groove 8*a* as shown in FIG. 4(*a*), or a step portion 8*b* may be formed on the movable contact shoe piece 8 so that the tip of the offset arm portion 15*a* can engage the portion 8*b*, as shown in FIG. 4(*b*).

With the structures described above, during assembly, by simply pressing and inserting the bent torsion coil springs 15 into upper and lower spaces of the contact shoe holder 9 with the movable contact shoe piece 8 loosely fitted in the contact shoe holder 9, the movable contact shoe 8 can be pressed and held in a predetermined position via the torsion coil springs 15.

Now, the embodiments described above will be compared with the conventional structures. First, they will be compared with the conventional structure in FIGS. 6(*a*) and 6(*b*) in which the tension springs, as the pressure springs 11, are disposed at the right and left sides of the movable contact shoe 8. The embodiments of the present invention do not require the rods 12 and 13, which are assembly parts for supporting the tension springs between the rods. According to the invention, the assembled structure is simplified, and assembly of the movable contact shoe 8 in the contact shoe holder can be done by using an assembly robot or the like.

Figure 7A:
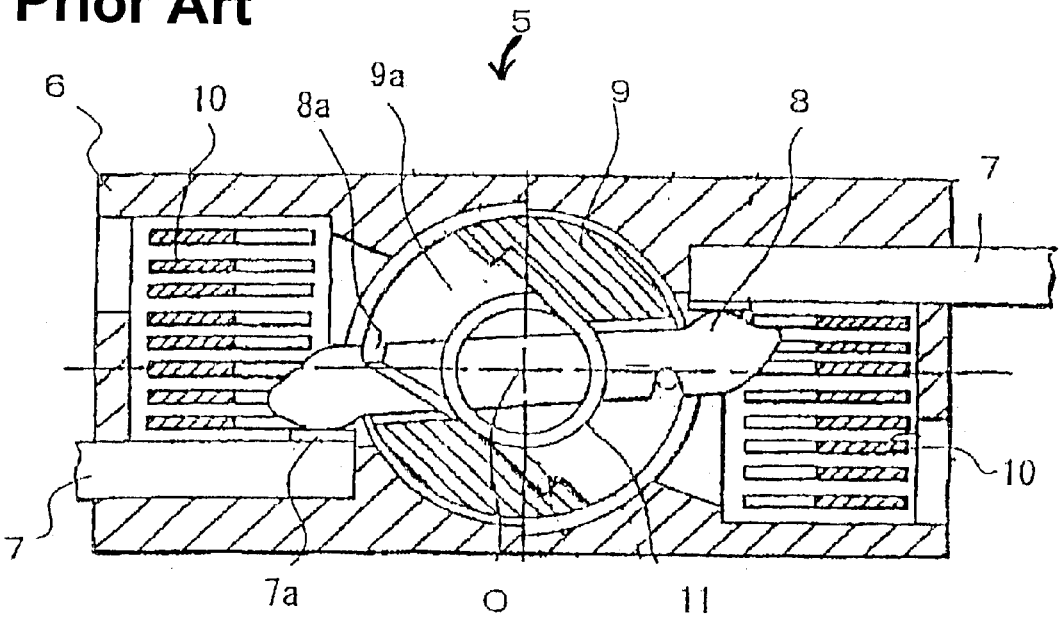
Fig. 7(a) Prior Art
FIGS. 7(*a*) and 7(*b*) are a plan view and a side view showing an internal structure of a current-interrupting section of another conventional example.
Figure 7B:
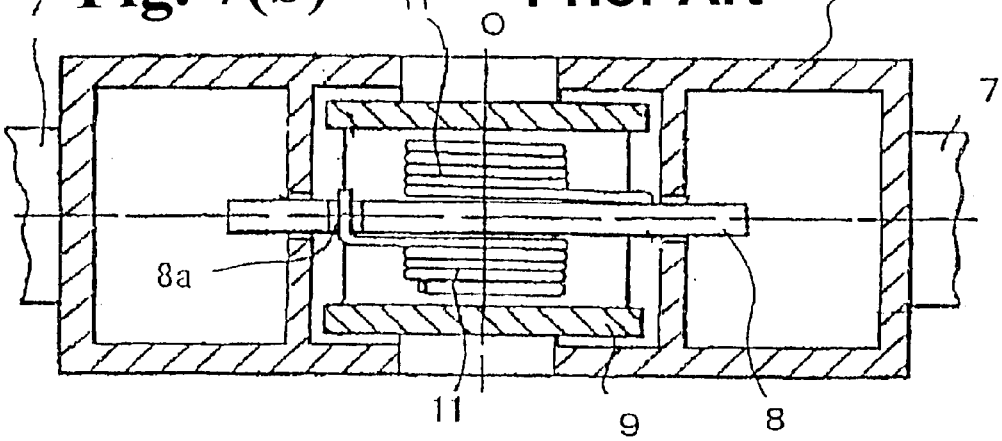
Fig. 7(b) Prior Art

The embodiments are also compared with the conventional structure in FIGS. 7(*a*) and 7(*b*) in which the two torsion coil springs, as the pressure springs 11, are separately arranged at the right and left sides of the movable contact shoe 8. If an outside dimension of the contact shoe holder 9 is the same, the length and the number of turns of the torsion coil spring 15 with an offset arm shown in FIG. 3 is up to twice longer and larger than those of the torsion coil spring in FIGS. 7(*a*) and 7(*b*), thereby reducing the spring constant down to about a half.

Consequently, with respect to an applied force of the torsion coil springs when the movable contact shoe 8 is opened by the electromagnetic reaction force resulting from over-current as described in FIGS. 6(*a*) and 6(*b*), the torsion coil springs 15 with the offset arms in the embodiments has a smaller difference in the spring forces applied to the movable contact shoe 8 between the contact activation position and the open position. This difference decreases to about a half of that of the shorter torsion coil springs in FIGS. 7(*a*) and 7(*b*). This reduces the force of the springs imposed on the movable contact shoe 8 during an opening operation associated with the electromagnetic reaction force, allowing the opening operation to be achieved promptly and without delay. Furthermore, the spring force used to push back the movable contact shoe 8 to the open position decreases, reducing the likelihood that the contacts will be inadvertently closed to turn on the circuit breaker again, thus improving the reliability of the corresponding interrupting operation.

As described above, according to the present invention, the pressure springs for pressing and holding the rotary bridge-type movable contact shoe of the current-interrupting section have a U-shaped offset arm portion drawn out from the center of the coil. The torsion coil springs are arranged above and under the movable contact shoe. Furthermore, the legs of the torsion coil spring, which are located at the respective ends thereof, are engaged with and locked to the respective sidewalls of the contact shoe holder. The offset arm portions engage the movable contact shoe at symmetrical positions with respect to the rotational center thereof. Consequently, this structure reduces the number of required parts and simplifies the assembly operation, as compared to the conventional structures with the tension springs as the pressure springs.

Furthermore, the spring constant of the pressure springs can be reduced to about a half of that in the conventional structures with the two torsion coil springs at both sides of the movable contact shoe, thereby improving the reliability of the opening operation of the molded case circuit breaker using the electromagnetic reaction force resulting from the over-current.

While the invention has been explained with reference to the specific embodiment of the invention, the explanation is illustrative and the invention is limited only by the appended claims.

What is claimed is:

1. A molded case circuit breaker, comprising:

a switching mechanism, and a current-interrupting section connected to the switching mechanism, and including an insulated case; a pair of fixed contact shoes; a rotary contact shoe disposed between the fixed contact shoes; a contact shoe holder linked to the switching mechanism and having a hole therein for holding the rotary contact shoe; and a pair of pressure springs for pressing the rotary contact shoe arranged above and under the rotary contact shoe, each pressure spring having a pair of torsion coil springs with an offset arm portion drawn out from a central portion thereof, and two ends engaging the contact shoe holder, said offset arm portions engaging the rotary contact shoe at positions symmetrical with respect to a rotational center of the rotary contact shoe.

2. A molded case circuit breaker according to claim 1, further comprising arc extinguishing devices disposed in the insulated case.

3. A molded case circuit breaker according to claim 1, wherein said two ends of the torsion coil springs are formed in an L-shape and are hooked on holes disposed on sidewalls of the contact shoe holder.

4. A molded case circuit breaker according to claim 1, wherein said two ends of the torsion coil springs are formed in an L-shape and are hooked on grooves disposed on peripheral edges of sidewalls of the contact shoe holder.

5. A molded case circuit breaker according to claim 1, wherein said movable contact shoe has grooves on top and bottom surfaces at positions symmetrical with respect to a center of the movable contact shoe, and said offset arm portions of the torsion coil springs engage the grooves.

6. A molded case circuit breaker according to claim 1, wherein said movable contact shoe has stepped portions on top and bottom surfaces at positions symmetrical with respect to a center of the movable contact shoe, and said offset arm portions of the torsion coil springs engage the stepped portions.

* * * * *

UNITED STATES PATENT AND TRADEMARK OFFICE

CERTIFICATE OF CORRECTION

PATENT NO. : 6,590,173 B2
DATED : July 8, 2003
INVENTOR(S) : Naoshi Uchida et al.

It is certified that error appears in the above-identified patent and that said Letters Patent is hereby corrected as shown below:

Column 6,
Line 67, delete "thereof" and add therefor -- between the pair of torsion coil springs --;

Column 7,
Line 9, change "on" to -- in -- (two occurrences);
Line 13, change "on" to -- in -- (two occurrences);

Column 8,
Line 12, after claim 6 add new claim 7, as follows:
-- 7. A molded case circuit breaker according to claim 1, wherein said pair of pressure springs is arranged parallel to each other with a space therebetween --.

Signed and Sealed this

Fourth Day of November, 2003

JAMES E. ROGAN
*Director of the United States Patent and Trademark Office*